United States Patent [19]

White et al.

[11] 4,048,349

[45] Sept. 13, 1977

[54] COMPOSITE METAL POLYMER FILMS

[75] Inventors: Martin White, Hassocks; Niyom Boonthanoom, Brighton, both of England

[73] Assignee: National Research Development Corporation, London, England

[21] Appl. No.: 530,018

[22] Filed: Dec. 5, 1974

[30] Foreign Application Priority Data

Dec. 7, 1973 United Kingdom ..... 56788/73

[51] Int. Cl.[2] ..... B05D 5/12; C23C 11/00

[52] U.S. Cl. ..... 427/58; 427/101; 427/102; 427/124; 427/125; 427/248 A; 427/248 B; 427/248 H; 427/250; 427/256; 427/271; 427/294; 427/377; 427/383 R; 427/383 A; 427/383 B; 427/383 C; 427/385 R; 427/385 A; 427/385 B; 427/385 C

[58] Field of Search ..... 428/457, 328, 329; 427/82, 101, 102, 123, 124, 399, 196, 201, 250, 58, 125, 248 A, 248 H, 248 B, 271, 294, 256, 377, 383 R, 383 A, 383 B, 383 C, 385 R, 385 A, 385 B, 385 C; 260/37 M, 42.22, 37 PC

[56] References Cited

U.S. PATENT DOCUMENTS

| | | | |
|---|---|---|---|
| 2,808,352 | 10/1957 | Coleman | 260/42.22 |
| 2,947,646 | 8/1960 | Devaney | 260/37 M |
| 2,951,246 | 8/1960 | Halpern | 260/37 M |
| 3,301,707 | 1/1967 | Loeb | 428/457 |
| 3,427,264 | 2/1969 | Forster et al. | 260/42.22 |
| 3,475,213 | 10/1969 | Stow | 428/328 |
| 3,746,662 | 7/1973 | Adelman | 260/37 M |
| 3,767,477 | 10/1973 | McCabe | 427/216 |
| 3,895,143 | 7/1975 | Tarlow | 260/42.22 |

FOREIGN PATENT DOCUMENTS

| | | | |
|---|---|---|---|
| 1,298,453 | 12/1972 | United Kingdom | 427/101 |
| 1,072,049 | 6/1967 | United Kingdom | 427/101 |

*Primary Examiner*—Michael F. Esposito
*Attorney, Agent, or Firm*—Finnegan, Henderson, Farabow & Garrett

[57] ABSTRACT

A process is described for producing a composite metal film in which metalliferous particles and polymer particles are co-deposited on a substrate, the proportion of metalliferous particles being such that the metal film is discontinuous, the metal particles being present in the form of islands with intervening zones of polymeric material. The resulting composite films have negative temperature coefficient of resistance. The process may be applied to the production of semiconductor composite films, e.g., copper oxide films by means of an annealing oxidative treatment to convert metal to metal oxide before loss of polymeric matrix by oxidation or evaporation.

17 Claims, 10 Drawing Figures

$10^{11}$
$10^{10}$
$10^{9}$
$10^{8}$
$10^{7}$
$10^{4}$
$10^{3}$
RESISTIVITY (Ω per Square)
A
B
C
D
0
1
2
TIME (HRS)

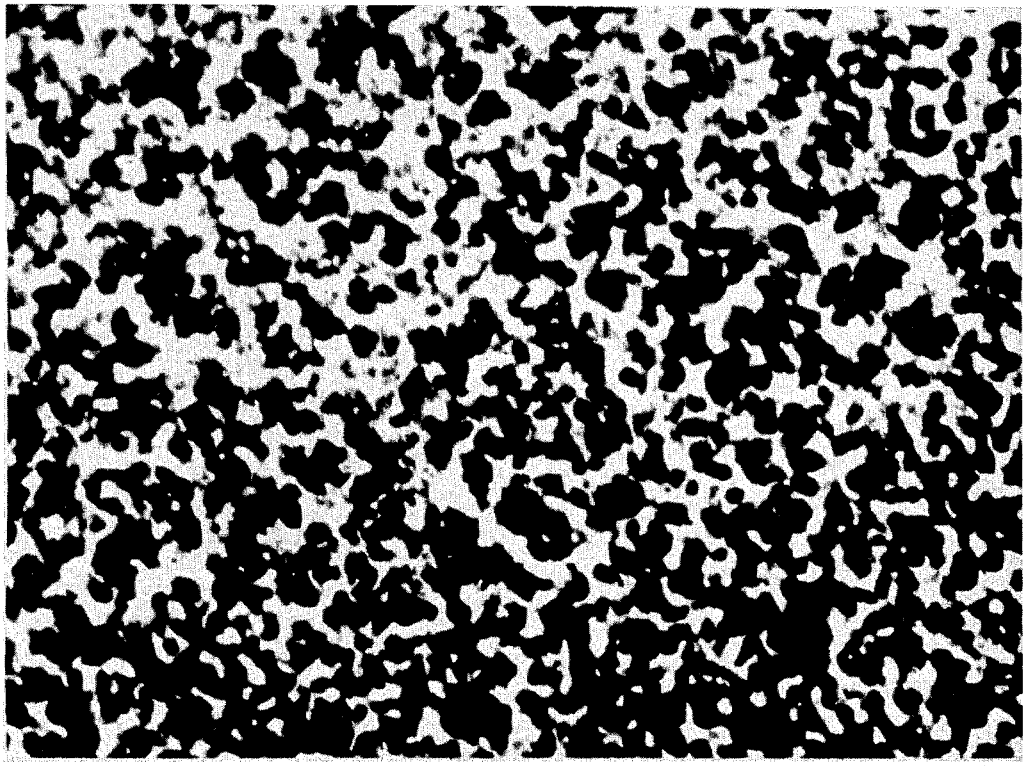
FIG. 4
FIG. 5
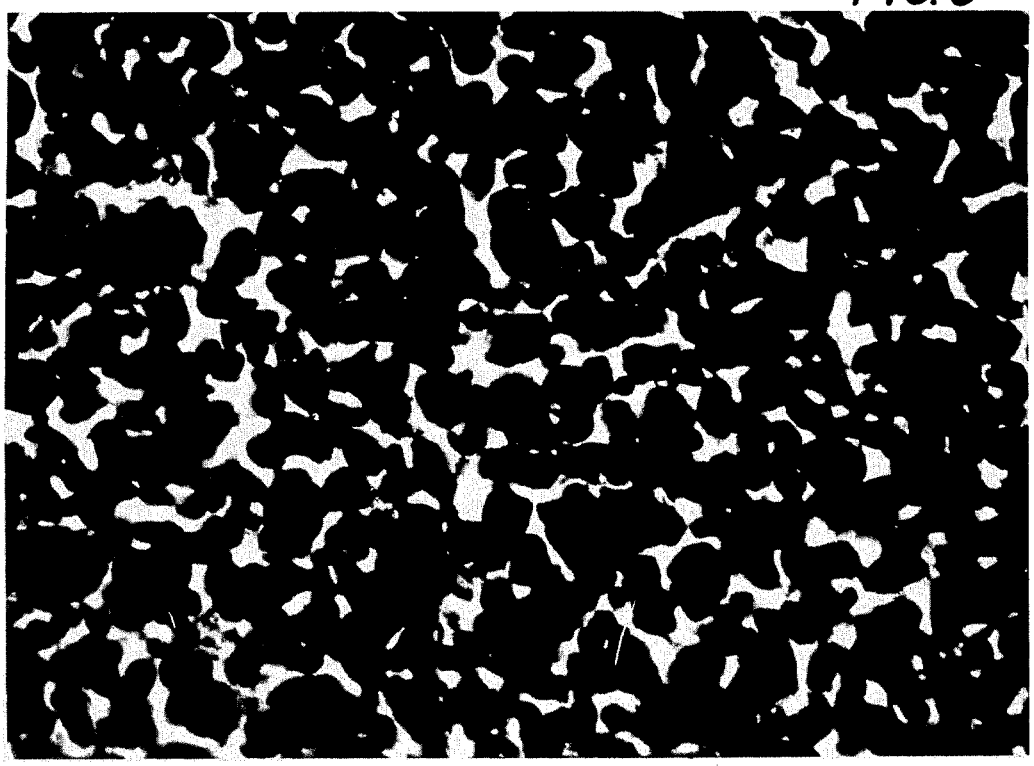

x10^8
4·0
3·0
2·0
x10^7
4·0
3·0
2·0
x10^3
9·0
8·0
7·0
6·0
RESISTIVITY (Ω/sq)
100
200
300
400
TEMPERATURE (°K)

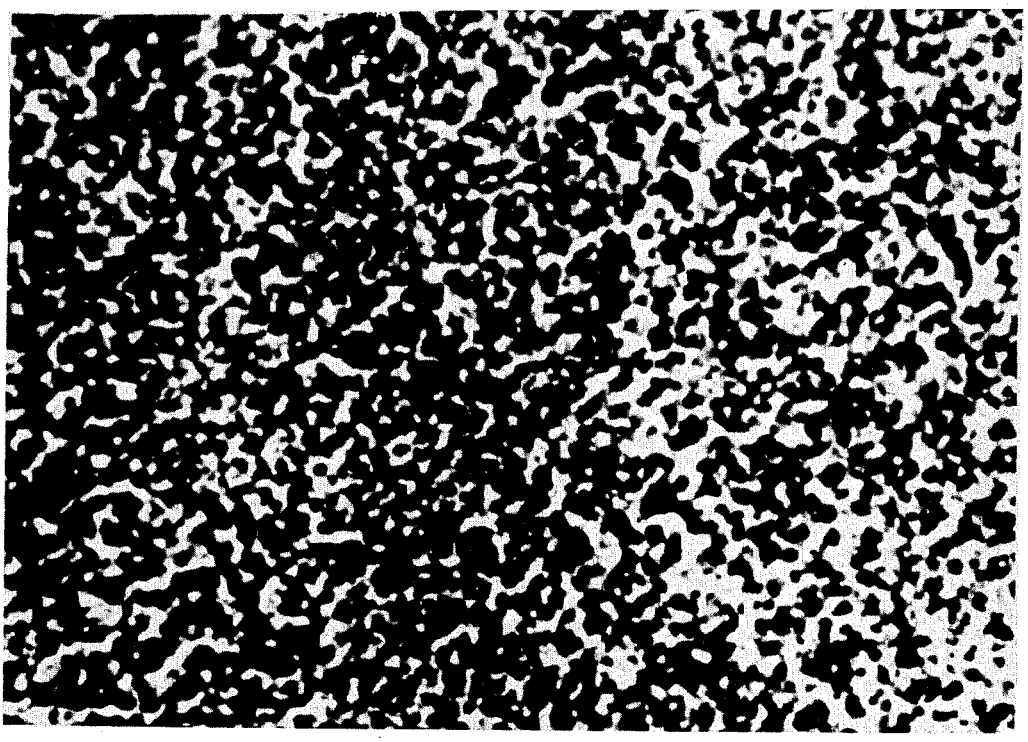
FIG. 7
FIG. 8
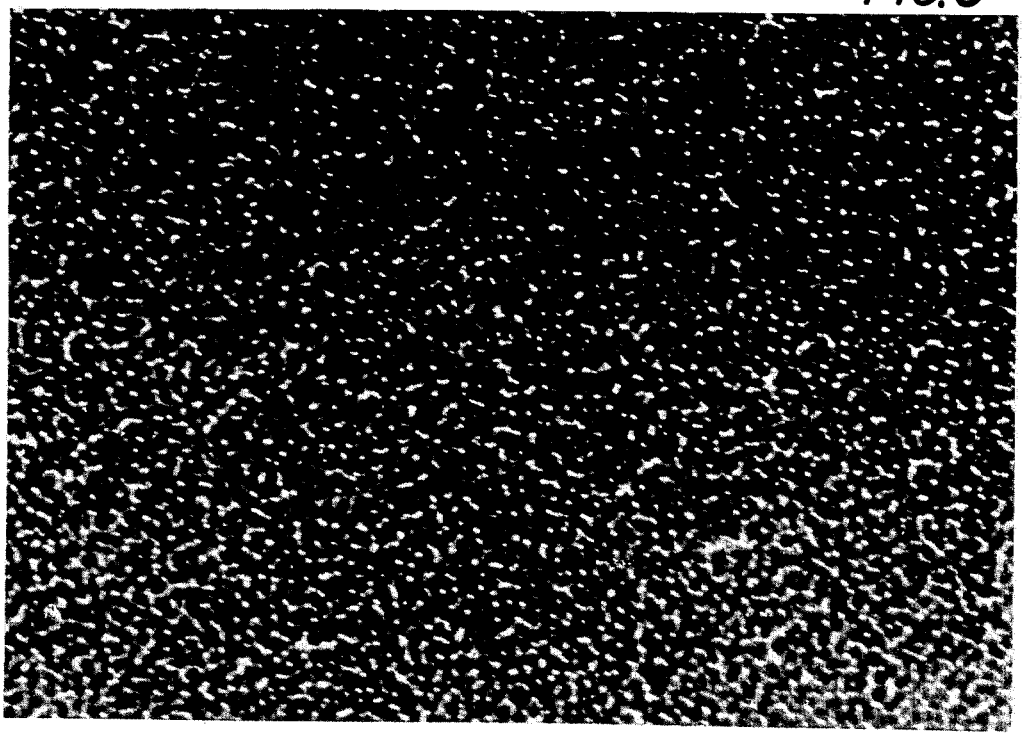

COMPOSITE METAL POLYMER FILMS

This invention relates to composite metal polymer films and to the production of such films by evaporation techniques.

It has been proposed in U.K. patent specification No. 1,072,049 to produce by vapor deposition composite films comprising metal and poly (p-xylylene) for use as thin film resistors in electric circuitry. In this prior specification considerable stress has been placed upon the production of an atomic or nearly atomic dispersion of metal in a polymer matrix leading in general to composite films having a positive temperature coefficient of resistance. Furthermore, the pressures at which the deposition process is carried out in specification No. 1,072,049 are determined by the chemistry of the polymer-forming component and are usually relatively high, e.g., about 1 micron.

It has now been found possible to produce composite metal polymer films having unusual and very valuable properties in which the metalliferous particles are dispersed in a polymeric matrix in the form of three dimensional dispersions of island structures, such products usually having a negative temperature coefficient of resistance. For example, with certain copper-polymer films surface and bulk resistivity values change by up to seven orders of magnitude over a temperature range of only 200° C. This high temperature sensitivity makes the material useful as a temperature sensor or temperature controller element.

Composite metal polymer films in accordance with the present invention are produced by so controlling the relative rates of deposition of metal and polymer particles that insufficient metal is deposited to form a continuous film, the metal particles being laid down instead in the form of islands with intervening zones of polymeric material thus resulting in a product which is initially electrically open circuited or having very high resistivity, e.g., greater than $10^{12}$ ohms per square.

To achieve stable electric properties it is necessary to subject the three-dimensional dispersion of metalliferous material in the polymeric matrix to a subsequent heat treatment. This heat treatment will for convenience be described in this specification as "annealing." The effect of annealing is time/temperature dependent and actual values of resistivity can be pre-determined by terminating annealing when the required value is reached. Annealing may be carried out at temperatures up to about 150° C or even higher but in most cases it is unnecessary to anneal at temperatures higher than about 200° C because little or no advantage is gained thereby. The principal effect of annealing is oxidative in the case of copper and aggregation in the case of silver. With copper, annealing may follow closely upon deposition whereas with silver a delay period is desirable before annealing is commenced, about two days being a recommended delay period.

To produce the composite films of the present invention techniques broadly similar to that described in our prior U.S. Pat. No. 1,298,453 may be used. However, for the purposes of our prior patent irradiation of the polymeric material during deposition is essential whereas in relation to the present invention an irradiation treatment either during or subsequent to the deposition process is merely optional. Irradiation generally toughens the polymer film and limits the degree of aggregation of metal particles and for this reason is usually undesirable although there may be circumstances in which its use is indicated.

The polymeric material and the metal are evaporated and deposited from different sources and strict control over the rate of evaporation and deposition is required. Particular importance is attached to the use of a constant rate of evaporation/deposition of the metallic material.

A variety of polymeric materials may be used. Polyethylene is eminently suitable as a polymeric material but valuable films can also be made with polycarbonates, polyvinylidine chloride and other polymers including polyethylene terephthalate. Examples of metals which may be used are gold, aluminum, chromium, tellurium, silver and copper.

Whilst the nature of the metalliferous particles in the film of the present invention is not at present fully known with certainty, it is believed that the metalliferous material is partly in the elementary metallic state and partly (in some cases almost entirely) in the form of a metal oxide, the relative proportion depending to some extent on the metal itself and the conditions used to prepare the product, particularly in the annealing step. It is probable that the metalliferous particles consist of a metallic core surrounded by a layer of metal oxide. The properties of the resultant film are unusual in that they are typical neither of the metal nor of the metal oxide. Thus in the case of silver and copper the proportion of oxide is significant whilst with aluminum and chromium the oxidation occurring during annealing proceeds probably further than would be desired for the best results unless protective non-oxidizing atmospheres are used. When gold is used as the metal very little oxide is present.

When composite films are produced according to the invention, and annealing is carried out at the higher temperatures, e.g., 200°–220° C, it is found in many cases that the amount of polymer remaining in the final product is quite small. The composite nature of the film in such cases is therefore of transient importance, the function of the polymeric matrix being primarily to prevent coalescence of the metalliferous islands during deposition and to allow aggregation or oxidation of discrete island structures as separate entities. In applying the process of the present invention to metals which form oxides with semiconducting properties, therefore, e.g., copper, tin, iron, a new technique for producing oxide films becomes possible at temperatures much lower than is used at present. For example prior methods of producing copper oxide semiconductors require oxidation temperatures of the order of 1200° C; with the method described above comparable results are achieved at about 200° C. The invention therefore also comprises a process for the production of a metal oxide film in which metalliferous particles and polymer particles are co-deposited on a substrate at such relative rates that metal particles are deposited as island structures separated by intervening zones of polymeric material, and the resulting composite film is subjected to an oxidative treatment in which substantial oxidation of the separate metal islands is achieved before loss of the polymer by oxidation and/or evaporation.

The invention is illustrated in the accompanying drawings of which,

FIGS. 3 to 9 are described later.

Figure 1:
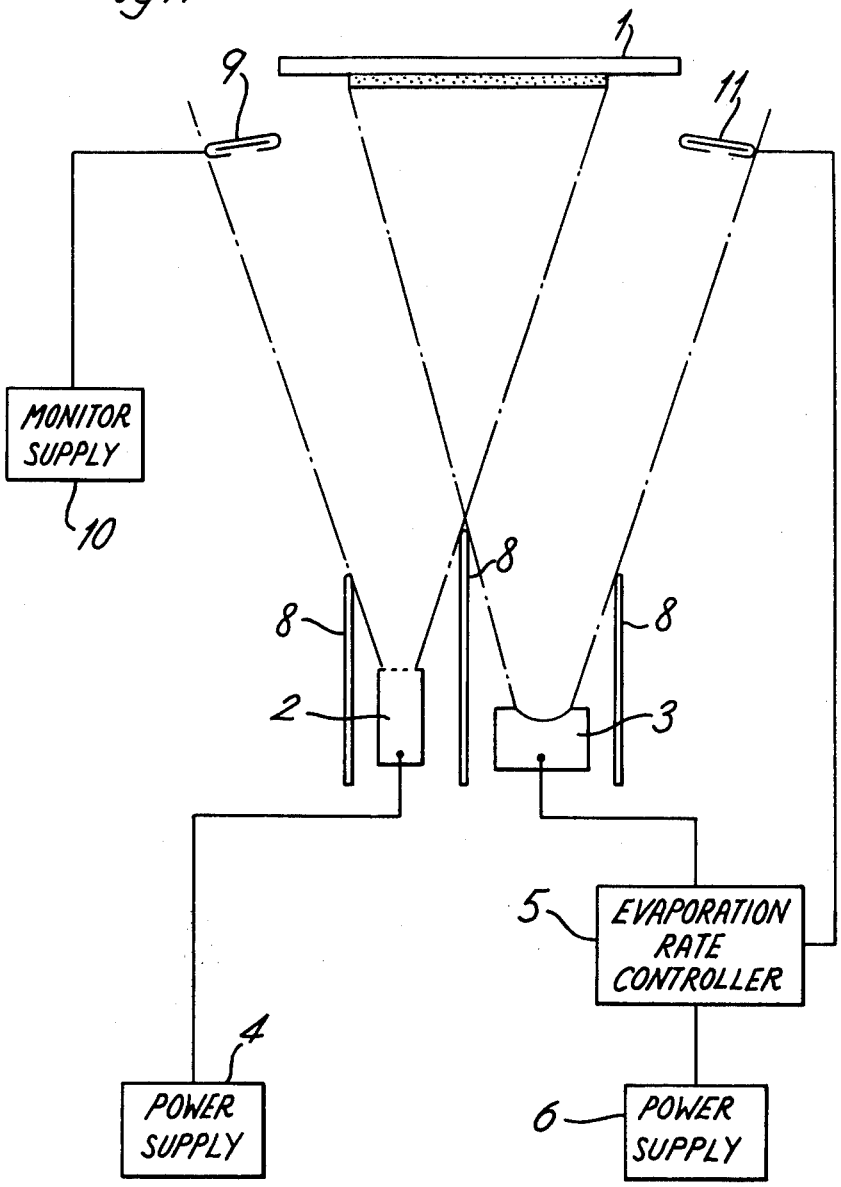
FIG. 1 is a diagrammatic representation of the apparatus used.

Referring to FIG. 1, the apparatus includes a vacuum chamber (not shown) in which the apparatus illustrated is enclosed. The apparatus comprises an electrically heated glass substrate 1 protected by a removable shutter (not shown) and disposed horizontally about 20 cm. above a polymer source 2 and a metal source 3. The polymer source 2 has the same form as that described with reference to the drawing in U.K. Pat. No. 1,298,453 and is activated from a power supply 4. The metal source 3 comprises molybdenum strip or boat containing metal granules and is electrically heated through an automatic evaporation rate controller 5 energized by a power supply 6.

The polymer and metal sources are shielded from each other and from other parts of the apparatus by means of shields 8 which provide for the emission of divergent beams of particles towards the substrate 1. The evaporation of polymer is controlled by a polymer monitor 9 and monitor supply 10, evaporation of metal being controlled by a metal monitor 11 through the evaporation rate controller 5. The configuration of the shields 8 is such that the beams of polymer and metal particles overlap where they impinge on the substrate 1.

An ultraviolet discharge lamp (not shown) mounted inside the chamber is used to radiate and toughen the polymer film if desired.

Electrical connections (not shown) passing through the vacuum chamber wall permit electrical measurements to be made on the deposited films during and subsequent to deposition.

In operating the apparatus gold conducting lands 12 (see FIG. 2) are first deposited on the substrate by known evaporation techniques using appropriate masks. The vacuum system is then brought to atmospheric pressure and electrical connections are made to the lands using conducting colloidal silver paste. The polymer and metal sources 2 and 3 are then charged with material and the system is re-evacuated down to pressures of about $10^{-5}$ torr using a pumping system that includes a liquid-nitrogen-cooled trap. The substrate temperature is maintained at 30° C during deposition.

The sources 2 and 3 are brought to operating temperature. When using polyethylene as the polymer an operating temperature of 380° C is typical. The conditions are adjusted until a deposition rate of about 17 A to about 30 A $min^{-1}$ is achieved. Similarly the metal deposition rate is adjusted to the desired level, e.g., with a range of 40–85 A $min^{-1}$ in the case of silver and within a range of 30–70 A $min^{-1}$ in the case of copper. When the appropriate level is achieved it is maintained at a constant value.

Figure 2:
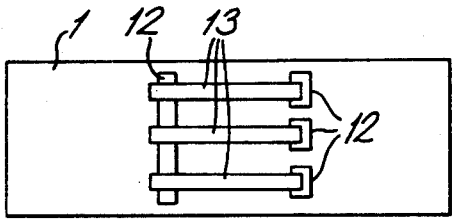
FIG. 2 illustrates composite films deposited therein.
Figure 2A:
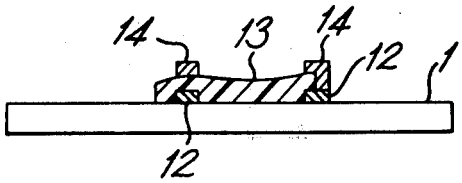

The protective shutter is then removed from the substrate and co-deposition allowed to proceed through suitable defining masks to establish the pattern of films 13 shown in FIG. 2.

At the end of co-deposition a second set of gold lands 14 is evaporated over the metal polymer film in an appropriate pattern.

After a suitable delay period annealing of the composite metal polymer film is achieved by raising the substrate temperature to values up to 200° C. Annealing is carried out either at reduced pressure of $10^{-1}$ torr or atmospheric pressure.

Typical conditions for polyethylene-silver and polyethylene-copper composite films are as follows:

| | P.E. + silver | P.E. + copper | |
|---|---|---|---|
| Deposition rate of P.E. | 30 | 30 | Å$min^{-1}$ |
| Deposition rate of metal | 40 - 85 | 30 - 70 | Å$min^{-1}$ |
| Total film thickness | 400 - 1500 | 400 1500 | Å |
| Resistivity | $10^7 - 10^{12}$ and $10^3 - 10^4$ | $10^6 - 10^8$ | ohm per square |
| Annealing temperature | 90 | 120 | ° C |
| Annealing time | 3 | 3 | hours |
| Resistivity after annealing | $10^8 - 10^9$ and $10^3 - 10^4$ | $10^8 - 10^9$ | ohm per square |

Experimental Results

I. Polyethylene-Silver

Figure 3:
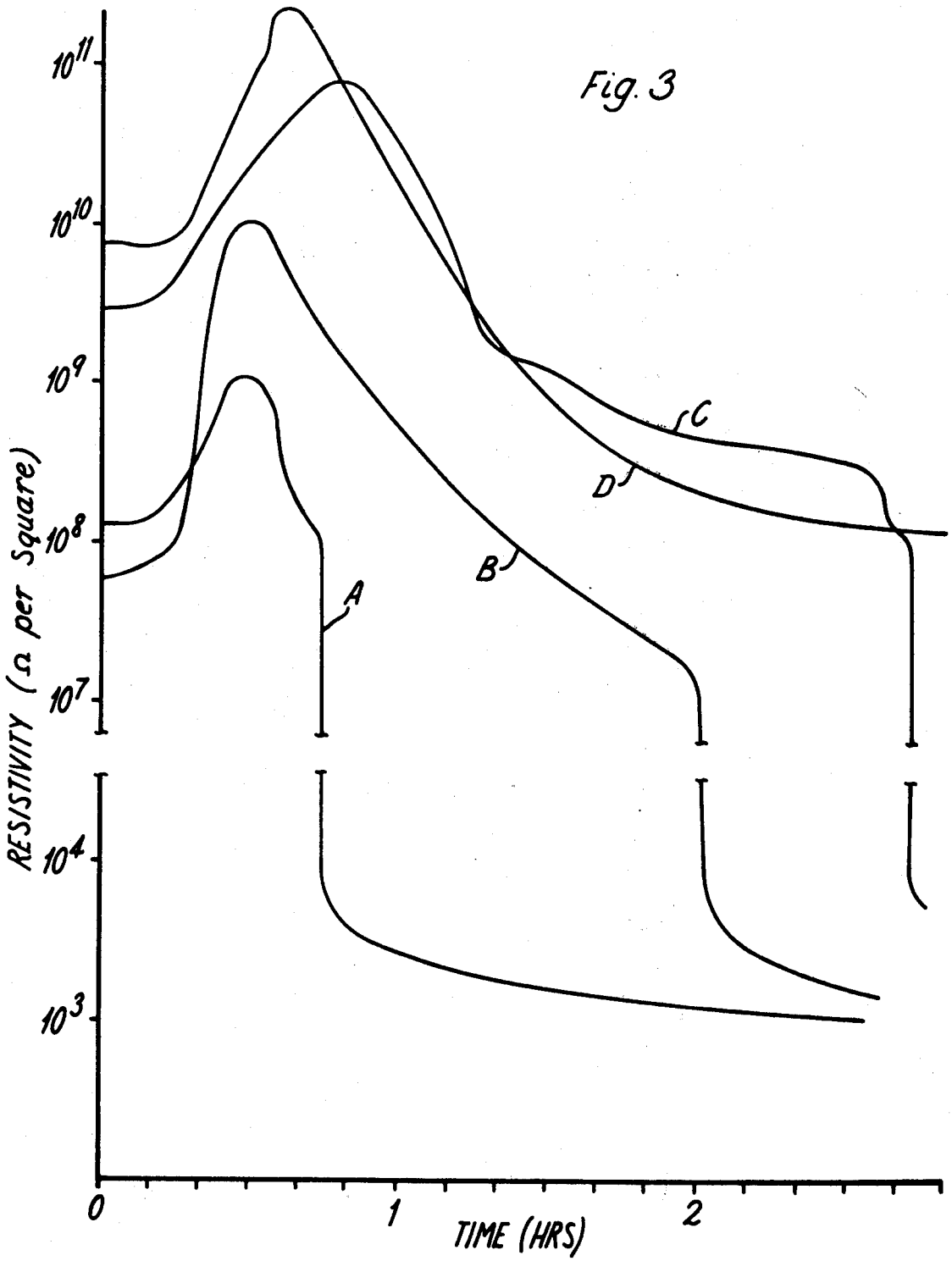

Immediately following deposition electrical resistivity was found to be unstable with time, and an annealing process was required before reproducibility was obtained. The annealing was carried out after a delay period following deposition of the film. In this way ageing effects were eliminated. The change in specific resistivity with annealing time is illustrated in FIG. 3 after various delay periods, viz, A, 15 hrs., B, 24 hrs., C, 2 days, D, above 2 days.

FIGS. 4 and 5 show electron micrographs of the structure of films respectively before and after annealing at 90° C. It can be observed that island growth has occurred during annealing, islands having diameter within the range 150–1000 A being seen. Annealing was carried out both at a reduced pressure ($10^{-2}$ torr) and in the atmosphere, in each case leading to similar island growth behavior.

Figure 6:
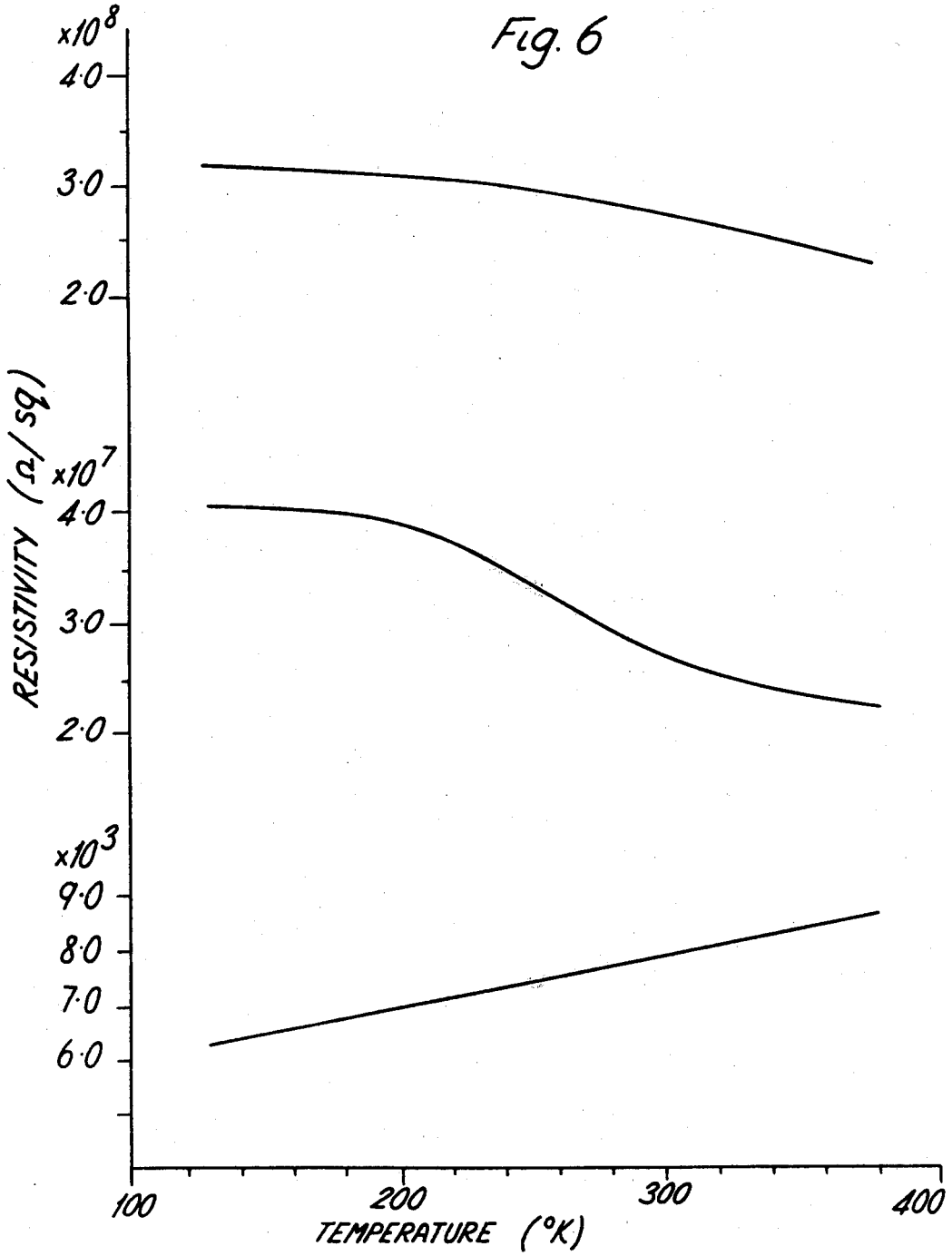

At the completion of annealing the variation of resistivity with film temperature is shown in FIG. 6.

The resulting films usually possess a resistivity greater than about $10^8$ ohm per square and have negative temperature coefficient of resistance. In contrast where the metal evaporation rate is raised to such high level that the island structures of metal are in contact the products have resistivity less than $10^4$ ohm per square and have positive temperature coefficient of resistance.

Once annealed, films exhibited no detectable changes in resistivity due to ageing effects.

All electrical measurements were made using gold contacts. Current-voltage relationships were in all cases found to be ohmic.

II. Polyethylene-Copper

Composite films of polyethylene and copper were formed in a similar manner to those of polyethylene and silver. The main difference in production lies in the annealing process which may be carried out at temperatures of up to 200° C, although it is usually done at 140° C, and is always carried out in atmosphere. The effect of this treatment was to convert islands of copper to $Cu_2O$. Island size was smaller than those obtained with silver, island diameters were found to be about 110 A, with little variation in size throughout the film. FIGS. 7 and 8 show electron micrographs of films respectively before and after annealing at 150° C. In the case of copper it was possible to perform electrical measurements both parallel and perpendicular to the surface of the film, in each case the value of specific resistivity of the composite material was the same.

Figure 9:
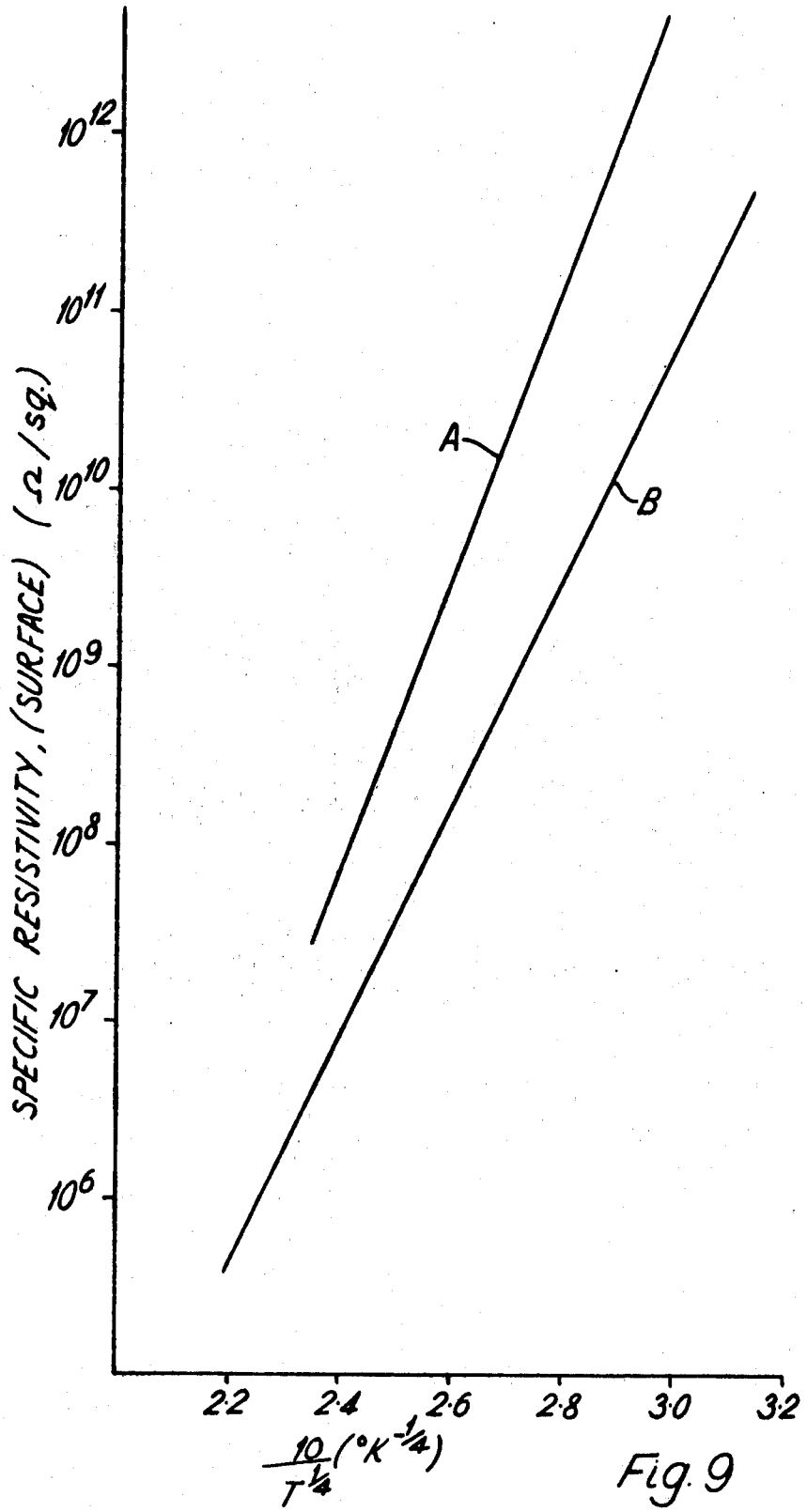

After annealing the variation of resistivity with film temperature was found to exhibit the characteristics shown in FIG. 9. FIG. 9 refers to surface resistivity measurements of two films, annealed at 375° K (graph A) and at 493° K (graph B) respectively. It is observed that a plot of log resistivity versus $10/T^{\frac{1}{4}}$ results in a straight line, indicative of a hopping mechanism of electrical conduction.

Gold electrodes were used for all measurements. As with silver composite films, ohmic characteristics were always exhibited. Dielectric breakdown was caused when the applied field was in excess of about $10^6 Vm^{-1}$.

No variation of resistivity with film age has been detected.

Films of a given resistance value have been produced simply by altering the aspect ratio in the case of high resistance values (surface conduction) or electrode size for low resistance values (bulk conduction).

We claim:

1. A process for producing a composite metal polymer film having a negative temperature coefficient of resistance, comprising co-depositing, by evaporation from separate sources in a vacuum, metalliferous particles and insulative polymer particles onto a substrate, the proportion of metalliferous particles being such that the metal in the film is discontinuous, the metal particles being present in the form of islands with intervening zones of polymeric material, the islands having diameters of from 110A to 1000A, and subjecting the film in an oxidizing atmosphere at from 200° to 220° C to an oxidative treatment in which substantial oxidation of the separate metal islands is achieved before loss of the polymer by oxidation and/or evaporation.

2. The process according to claim 1 in which the heat treatment is effected at from 90° to 200° C.

3. The process according to claim 1, in which the metal and polymer are deposited from different sources at controlled rates.

4. The process according to claim 3, in which metallic material is evaporated and deposited on the substrate at a constant rate.

5. The process according to claim 1, in which the metal is copper, silver, tellurium, chromium, aluminum or gold.

6. A process according to claim 5, in which the polymer is polyethylene.

7. A process according to claim 1, in which the metal oxide is copper, tin or iron.

8. A process for producing a composite metal polymer film having a negative temperature coefficient of resistance, comprising co-depositing, by evaporation from separate sources in a vacuum, metalliferous particles and insulative polymer particles onto a substrate;

controlling the relative rates of deposition of the metalliferous particles and polymer particles to attain a proportion of metalliferous particles such that the metal in the film is discontinous, the metal particles being present in the form of islands with intervening zones of polymeric material, the islands having diameters of from 110A to 1000A; and subjecting the film in an oxidizing atmosphere at from 200° to 220° C to an oxidative treatment in which substantial oxidation of the separate metal islands is achieved before loss of the polymer by oxidation and/or evaporation.

9. The process according to claim 8, in which the heat treatment is effected at from 90° to 200° C.

10. The process according to claim 9, in which metallic material is evaporated and deposited on the substrate at a constant rate.

11. The process according to claim 9, in which the metal is selected from the group consisting of copper, silver, tellurium, chromium, aluminum and gold.

12. The process according to claim 8, in which the polymer is polyethylene, a polycarbonate, polyvinylidine chloride or polyethylene terephthalate.

13. A process according to claim 12, in which the polymer is polyethylene, and the deposition rate is about 17A to 30A $min^{-1}$.

14. The process according to claim 13 in which the metal is silver, the deposition rate of polyethylene is about 30A $min^{-1}$, the deposition rate of silver is about 40A to 85A $min^{-1}$ to a total film thickness of about 400A to 1500A, and the heat treatment is at about 90° C for about 3 hours.

15. The process according to claim 13 in which the metal is copper, the deposition rate of polyethylene is about 30A $min^{-1}$, the deposition rate of copper is about 30A to 70A $min^{-1}$ to a total thickness of about 400A to 1500A and the heat treatment is at 120° C for about 3 hours.

16. A process for producing a metal oxide film, comprising i. co-depositing, by evaporation from separate sources in a vacuum, metalliferous particles and insulative polymer particles onto a substrate, ii. controlling the relative rates of deposition of the metalliferous particles and polymer particles to attain the proportion of metalliferous particles such that the metal in the film is discontinuous, the metal particles being present in the form of islands with intervening zones of polymeric material, the islands having diameters of from 110A to 1000A, and (ii) heat-treating the film; and subjecting the film in an oxidizing atmosphere at from 200° to 220° C to an oxidative treatment in which substantial oxidation of the separate metal islands is achieved before loss of the polymer by oxidation and/or evaporation.

17. A process according to claim 16, in which the metal oxide is copper, tin or iron.

* * * * *